US009418767B2

(12) United States Patent
Soejima et al.

(10) Patent No.: US 9,418,767 B2
(45) Date of Patent: Aug. 16, 2016

(54) X-RAY FOCUSING DEVICE

(75) Inventors: Hiroyoshi Soejima, Kyoto (JP); Toshiro Kitamura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 478 days.

(21) Appl. No.: 13/456,022

(22) Filed: Apr. 25, 2012

(65) Prior Publication Data

US 2012/0207280 A1 Aug. 16, 2012

(30) Foreign Application Priority Data

Oct. 20, 2009 (JP) ..... 2009-241701

(51) Int. Cl.
*G21K 1/06* (2006.01)

(52) U.S. Cl.
CPC ..... *G21K 1/067* (2013.01)

(58) Field of Classification Search
CPC ..... A61B 6/06; A61B 6/542; G21K 1/02; G21K 1/06; G21K 1/025; G21K 1/067; G21K 1/062; G21K 1/04; G21K 2201/064; G21K 2201/067
USPC ..... 378/84, 147, 149
See application file for complete search history.

(56) References Cited

U.S. PATENT DOCUMENTS

| | | | | |
|---|---|---|---|---|
| 5,812,631 | A * | 9/1998 | Yan et al. | 378/85 |
| 6,504,901 | B1 * | 1/2003 | Loxley et al. | 378/84 |
| 2010/0226477 | A1 | 9/2010 | Nakazawa et al. | 378/64 |

FOREIGN PATENT DOCUMENTS

| | | |
|---|---|---|
| JP | 07-011600 | 2/1995 |
| JP | 07-040080 | 5/1995 |
| JP | 2007-093315 | 4/2007 |
| JP | 2007-093316 | 4/2007 |
| JP | 2007-225314 | 9/2007 |
| JP | 2008-164503 A | 7/2008 |

OTHER PUBLICATIONS

Examination Report received for Japanese Patent Application No. 2009-241701, mailed Oct. 2, 2012, 6 pages (3 pages of English Translation and 3 pages of Office Action).

* cited by examiner

*Primary Examiner* — Hoon Song
(74) *Attorney, Agent, or Firm* — Morgan, Lewis & Bockius LLP

(57) ABSTRACT

The X-ray focusing device includes a point/parallel type multi-capillary X-ray lens (MCX) and a point/parallel type single capillary X-ray lens (SCX). MCX and SCX are positioned so that the end face of the parallel end of SCX is positioned closed to the focal point position on the converging end of MCX so that the optical axes of the two coincide. X-rays that are efficiently collected by MCX are emitted from the converging end and become incident to the end face of parallel end of SCX so that the X-rays are efficiently incorporated into SCX. The X-rays are then irradiated from the converging end of SCX onto focal point having a small diameter. This allows taking advantages of MCX and SCX while compensating for their disadvantages.

3 Claims, 5 Drawing Sheets

X-RAY FOCUSING DEVICE

TECHNICAL FIELD

The present invention relates to an X-ray focusing device that is used for focusing X-rays in various apparatuses that use X-rays such as electron probe micro-analyzer (EPMA), scanning electron microscope (SEM), transmission electron microscope (TEM), X-ray fluorescence spectrometer, XRD, X-ray CT and medical X-ray devices.

BACKGROUND ART

With micro-area X-ray fluorescence spectrometers that are used for performing component analysis on a micro-area of a specimen, X-rays that are emitted from an X-ray source must be focused to a very small diameter and irradiated onto the specimen. With the micro-area X-ray fluorescence spectrometer that is described in Non-Patent Literature 1, multi-capillary (the term used in the literature is "polycapillary" but the more commonly used term "multi-capillary" is used in this specification) X-ray lens is used.

The multi-capillary X-ray lens ("MCX") is briefly explained next (see Patent Literature 1 and 2, etc.). FIG. 5 shows one mode of a MCX. FIG. 6 shows the principle behind the transmission of X-rays with a MCX. The basic construction of a MCX consists of numerous (approximately several hundred to a million) capillaries that are bundled together, each capillary being made of borosilicate glass and having a very small inner diameter in the range of approximately 2 μm to a dozen μm or so. As FIG. 6 shows, an X-ray beam that enters into a capillary 32 advances through the capillary while engaging in total reflection off the inner wall surface of the glass wall at an angle less than the critical angle. This principle is used to efficiently guide an X-ray. An X-ray can be efficiently guided whether the capillary 32 is linear-shaped such as that shown in FIG. 6(*a*) or bow-shaped such as that shown in FIG. 6(*b*).

There are many types of MCX. FIG. 5(*a*) shows a point/point type MCX 30 wherein X-rays that are emitted from an X-ray source that can be considered to be substantially a point are collected at the incident-side end face with a large solid angle and X-rays that are emitted from the emission-side end face on the opposite side is focused to a single point. With the MCX shown in FIG. 5(*b*), X-rays that are emitted from an X-ray source that similarly can be considered to be substantially a point are collected at the incident-side end face having a large solid angle and the X-rays are emitted as parallel beams from the emission-side end face. The MCX shown in FIG. 5(*b*) can also be a point/parallel type MCX 31 where the direction of travel is reversed.

Because, as afore-described, MCX is capable of collecting and guiding X-rays with a high efficiency, it is capable of irradiating a specimen with an X-ray having a high energy density and is therefore very effective in increasing the analysis sensitivity. On the other hand, it is not always very capable of focusing the X-rays, which have been collected with a high efficiency, onto a small irradiation area. One of the major reasons for this is that MCX, by its very principle of operation, causes blurring of the focal point. To explain, as shown in FIG. 7, because the X-ray travels through one capillary 32 while engaging in total reflection off the inner wall surface, the maximum reflection angle is the critical angle. For that reason, when the X-ray is emitted from the end face of capillary 32, the X-ray will have a divergence angle with respect to the optical axis (the center line of capillary 32) S with the maximum divergence angle being the critical angle θ. As a result, as shown in FIG. 8, the irradiation area of the X-ray that emerges from point-focus side end face 33 of MCX does not form an ideal point and instead forms an area 34 having a certain size.

Furthermore, even if the X-ray that emerges from the end face of a single-capillary 32 is made to be non-diverging, because of the limitations with the manufacturing of MCX, it is practically speaking impossible to cause all of the optical axes of a vast number of capillaries to perfectly focus to a single point. This factor also becomes a cause for the blurring of the focal point.

Because of the combination of such theoretical factors and the manufacturing limitations, the minimum focal point size of previous MCX has been limited to at most about 20 to 30 μm, and achieving any reduction in focal point size has been difficult. For example, with the device that is described in Non-Patent Literature 1, the size of the micro-area where the X-ray is irradiated is about 50 μm.

In recent years, there has been a strong need with analytic instruments such as micro-area X-ray fluorescence spectrometer and the like to perform measurements of components that are present in minute quantities in micro-areas. In response to such need, novel X-ray focusing devices that reduce the size of irradiation diameter of X-rays have been proposed. Patent Literature 3 combines MCX with a focusing member having a truncated cone shape, and Patent Literature 4 combines MCX with a Fresnel zone plate (FZP). Even though it is possible with these configurations to reduce the X-ray irradiation diameter to less than that achieved with MCX alone, the configuration of Patent Literature 3 has a tendency to reduce the intensity of the X-rays in the irradiated areas and is disadvantageous in terms of sensitivity, and the configuration of Patent Literature 4 has a cost disadvantage because of the very expensive cost of FZP required for obtaining a sufficient level of performance. So, both methods have their advantages and disadvantages.

PRIOR ART LITERATURE

Patent Literature

Patent Literature 1: Examined Patent Application Publication No. H07-11600

Patent Literature 2: Examined Patent Application Publication No. H07-40080

Patent Literature 3: Unexamined Patent Application Publication No. 2007-93315

Patent Literature 4: Unexamined Patent Application Publication No. 2007-93316

Patent Literature 5: Unexamined Patent Application Publication No. 2007-225314

Non-Patent Literature

Non-Patent Literature 1: "Energy Dispersive Micro X-ray Fluorescence Spectrometer μEDX Series," Online, Shimadzu Corporation, searched Oct. 15, 2009, Internet, URL: http://www.shimadzu.co.jp/surface/products/m_edx/index.html

OVERVIEW OF THE INVENTION

Problems to be Solved by the Invention

The present invention was made to solve the afore-described problems, and it is the object of the present invention to provide an X-ray focusing device that can focus X-rays to a very small diameter while, at the same time, securing a high X-ray intensity in the X-ray irradiated area and providing cost advantages.

As afore-described, MCX is advantageous in efficiently collecting X-rays that are emitted from an X-ray source and increasing the energy density of the X-rays at the irradiated area, but is limited in the ability to reduce the X-ray irradiation diameter. As a way of taking advantage of the afore-described advantages of MCX while compensating for its disadvantages, the inventors of the present application focused on a single-capillary X-ray lens ("SCX") as an X-ray optical device whose properties are different from (opposite of) those of MCX. As its name literally states, SCX uses only one capillary. As FIG. 9 shows, an X-ray that is introduced into the interior of one glass capillary 40 is focused as the X-ray reflects off the inner wall surface of the glass capillary 40 once or a plurality of times at an angle less than the critical angle. The X-ray that emerges from the tapered end face 41 at the tip can be formed to have a very small focal point with a diameter of 10 μm or less.

The afore-described SCX is advantages in terms of reducing the irradiation area of the X-ray while having a low cost because of its relatively easy manufacturing. At the same time, however, because the diameter of the X-ray incident-side end face cannot be made large, the incident efficiency of the X-ray is poor. This results in a low energy density of the X-ray irradiated area. Another way of stating this is that the advantages and disadvantages of SCX and MCX are the exact opposites. The inventors of the present application realized that by suitably combining the two, the advantages of either can be brought to the fore while compensating for the disadvantages, and that an X-ray focusing device with superior performance but a low cost can be realized.

Means for Solving the Problems

The X-ray focusing device according to the present invention, which was invented, for solving the afore-described problems includes:

a multi-capillary including a plurality of bundled capillaries for guiding X-rays and whose, at least, one end face is a converging end for concentratedly irradiating X-ray to a micro-area located outside of the end face; and a single-capillary including one capillary for guiding X-rays and whose, at least, one end face is a converging end for irradiating X-rays to a micro-area located outside of the end face and whose other end face is a long-focal length converging end or a parallel end capable of accepting parallel X-ray beams;

wherein the parallel end or the long-focal length converging end of the single-capillary is positioned outside the converging end of the multi-capillary, and the multi-capillary and the single-capillary are positioned so that the optical axis of the multi-capillary at the converging end coincides with the optical axis of the single-capillary at the parallel end or the long-focal length converging end.

With the X-ray focusing device according to the present invention, one end face of the multi-capillary is a converging end but the other end face may either be a converging end or a parallel end.

With the X-ray focusing device according to the present invention, the X-ray that has been efficiently guided through each capillary of the multi-capillary is emitted from the converging end and forms a focal point whose area size is relatively large. As one desirable mode of the present invention, the inner diameter (diameter of the area that can accept X-ray) of the incident end face at the converging end with a long-focal length or the parallel end is made larger than the diameter of the X-ray irradiated area that is formed at the focal point at the converging end of the afore-described multi-capillary, and the position of the multi-capillary and the single-capillary is set so that the incident end face of the single-capillary is positioned near the position of the focal point.

As afore-described, the size of the focal point outside of the converging end of the multi-capillary is large, but the X-ray that is emitted from the converging end, when viewed from the incident end face of the single-capillary, can be deemed as a light source that gradually joins the focal point or as an approximately parallel light source. Because of this, the X-ray that is emitted from the converging end of the multi-capillary is efficiently taken into the single-capillary. The X-ray is then focused onto a very small diameter by the single-capillary and is emitted from its converging end to irradiate a very small area in a concentrated manner.

Ignoring the loss in X-ray as it passes through multi-capillaries or a single-capillary and the loss in X-ray as the X-ray that is emitted from multi-capillaries becomes incident to the single-capillary, since numerous X-ray beams that were introduced into the multi-capillaries are ultimately irradiated onto a very small area from the converging end of the single-capillary, the X-ray energy density at the irradiated area becomes extremely high. Needless to say, the loss in X-ray during transit cannot be reduced to zero, but in the afore-described mode, since the loss in X-rays as the X-rays that are emitted from the multi-capillaries becomes incident to the single-capillary can be kept low, the final energy density at the X-ray irradiated area is kept sufficiently high.

Effects of the Invention

With the X-ray focusing device according to the present invention, the X-ray that is emitted from an X-ray source is efficiently collected by multi-capillaries, thus increasing the X-ray intensity. The X-ray is then irradiated onto a very small area in a concentrated manner by a single-capillary. By so doing, the area of the X-ray irradiated spot is made much smaller as compared to an ordinary MCX, and at the same time, even if the same X-ray source were to be used, the X-ray energy density at the X-ray irradiated area is made significantly larger as compared to before. This allows information that is obtained by the interaction (transmission, reflection, absorption, etc.) between the X-ray and the substances that exist at the micro-area to be detected with high sensitivity and accuracy.

Furthermore, because a single-capillary can be manufactured more easily and inexpensively as compared to a multi-capillary, the X-ray focusing device according to the present invention, which combines these components, is not that much more expensive as compared to a multi-capillary X-ray lens alone, thus providing a X-ray focusing device of a high performance yet low cost.

MODES FOR PRACTICING THE INVENTION

One embodiment of an X-ray focusing device according to the present invention is described next with reference to the attached drawings.

Figure 1:
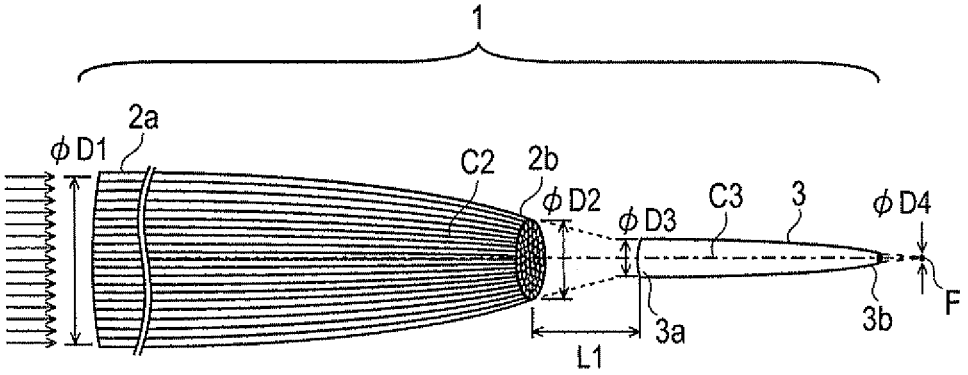
FIG. 1 shows the configuration of the major elements of one embodiment of an X-ray focusing device according to the present invention.
Figure 2:
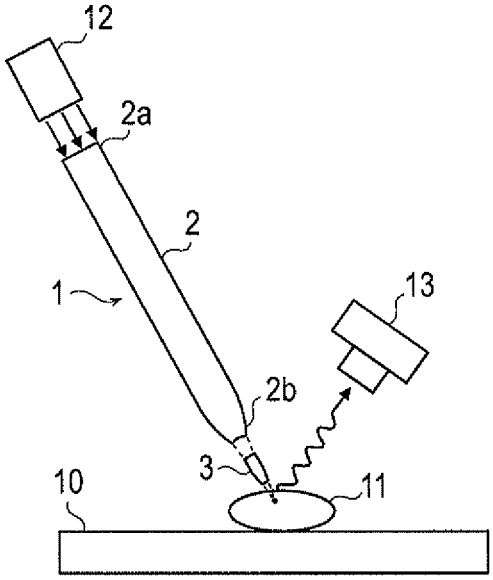
FIG. 2 shows a schematic view of the configuration of an X-ray inspection device using the present embodiment of the X-ray focusing device.
Figure 3:
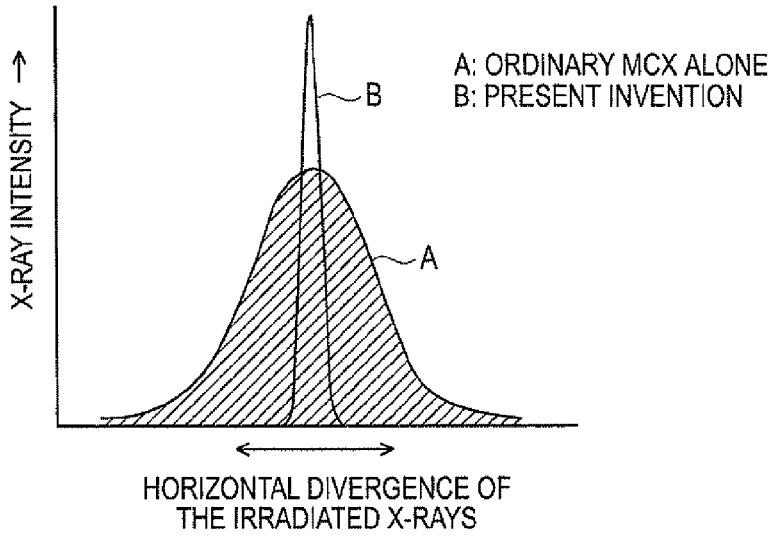
FIG. 3 is a schematic view showing the effects of the present embodiment of the X-ray focusing device.

FIG. 1 shows the configuration of the major elements of the present embodiment of an X-ray focusing device according to the present invention. FIG. 2 shows a schematic view of the configuration of an X-ray inspection device using the present embodiment of the X-ray focusing device. FIG. 3 is a schematic view showing the effects of the present embodiment of the X-ray focusing device.

The present embodiment of the X-ray focusing device 1 comprises a multi-capillary X-ray lens (MCX) 2 and a single-capillary X-ray lens (SCX) 3. MCX 2 has a point/parallel type structure with its one end being a converging end 2*b* having a point focus that can be considered to be a single point (which, in fact, as described later, is a large size) if one were to assume that light that is emitted from each of the capillaries does not diverge after their emission. Its other end is a parallel end 2*a*. SCX 3 has a point/parallel type structure with its one end being a parallel end 3*a* with a substantially tubular shape and its other end being a converging end 3*b* with a tapered tip. The end face of the converging end 2*b* of MCX 2 and the end face of the parallel end 3*a* of SCX 3 oppose each other and are separated by distance L1. The distance L1 is equal to the distance from the end face of converging end 2*b* of MCX 2 to the focal point that is formed outside the end face of converging end 2*b*, i.e., the distance L1 is equal to the focal distance. The optical axis C2 at the converging end 2*b* of MCX 2 coincides with optical axis C3 of the parallel end 3*a* of SCX 3.

Hence, the focal point of the X-ray that is emitted from the converging end 2*b* of MCX 2 is situated on the end face of the parallel end 3*a* of SCX 3. The diameter of the X-ray irradiated area for MCX 2, which is minimum at that position, is about several dozen μm to about 100 μm. On the other hand, the diameter ϕD3 of the area that can accept X-ray at the end face of the parallel end 3*a* of SCX 3 is usually about 0.1 mm to 1 mm, which is larger than the afore-described diameter of the X-ray irradiated area. This means that all of the X-ray that is emitted from the converging end 2*b* of MCX 2 become incident to the X-ray acceptable area on the end face of the parallel end 3*a* of SCX 3.

Now, assuming that the loss in X-ray while passing through MCX 2 can be ignored and that the inner diameter of the parallel end 2*a* is ϕD1 and the inner diameter of the converging end 2*b* is ϕD2, the energy density of the X-ray that is emitted from the converging end 2*b* is going to be approximately $\phi D2^2/\phi D1^2$ times greater than the energy density of the X-ray that is introduced into the parallel end 2*a*. (Here, the thickness of the walls separating the adjacent capillaries is ignored.) For example, if ϕD1=3 mm and ϕD2=0.1 mm, the X-ray energy density will be about 900 times greater.

Again assuming that all of the X-ray that is emitted from the converging end 2*b* of MCX 2 is all incorporated into SCX 3 and that any loss in X-ray during passage through SCX 3 can be ignored, and letting ϕD4 represent the irradiation diameter at focal point F of the X-ray that is emitted from the converging end 3*b* of SCX 3, the energy density of the X-ray at focal point F becomes approximately $\phi D4^2/\phi D2^2$ times greater. For example, if ϕD4=10 μm, the final energy density of the X-ray of the X-ray focusing device 1 at focal point F becomes approximately 100 times greater. In other words, the energy density of the X-ray at focal point F is going to be 90,000 times greater than the energy density of the X-ray that was initially incident on MCX 2.

In actuality, the loss in X-ray as the X-ray is guided through MCX 2 and SCX 3 is not zero. Also, some of the X-ray that is introduced into SCX 3 through the end face of the parallel end 3*a* will exceed the critical angle for a total reflection on the inner wall surface of SCX 3, and such X-ray will not be used (will be lost). These factors mean that the actual increase in energy density of the X-ray will be less than the aforesaid approximations, but nevertheless, the X-ray energy density at focal point F will be dramatically higher than the case with MCX alone. In general, the transmittance of MCX or SCX when loss is accounted for is said to be about 30%. When this factor is accounted for, the aforesaid increase of 90,000-fold drops to about 9,000-fold, but this is still a very large effect.

The afore-described operation and effect can be easily understood based on FIG. 3. FIG. 3 is a graph that plots along the horizontal axis the divergence in the horizontal direction of the irradiated X-ray at focal point F, and plots along the vertical axis the light quantum count (i.e., the X-ray intensity). The area of the region bounded by the curve such as that shown in the graph represents the total number of light quantum of all irradiated X-ray. To explain, when an MCX alone is used, as shown by curve A in the graph, for reasons already described, the irradiated X-ray cannot be focused very much, resulting in the divergence of the irradiated X-ray to be relatively large (minimum of about 20 to 30 μm). In contrast to this, with the present embodiment of X-ray focusing device 1, the same property is represented by curve B in the figure, showing that the irradiated X-ray can be narrowly focused as compared to previous. Furthermore, the X-ray intensity in the irradiated range is quite high.

As shown in FIG. 2, with an X-ray inspection device that employs the present embodiment of the X-ray focusing device 1, an X-ray focusing device 1 is installed between an X-ray source 12 and an inspected object 11 that moves on a manufacturing line 10. Primary X-ray that is emitted from the X-ray source 12 is efficiently focused to a small diameter by the X-ray focusing device 1 and is irradiated onto the inspected object 11. The secondary X-ray that is released from the inspected object 11 is detected by the X-ray detector 13, and information (such as an image) from the X-ray irradiation site on the inspected object 11 is obtained based on the detection signal. It is certainly acceptable to install a MCX on the detection side.

As afore-described, with the present embodiment of the X-ray focusing device, MCX 2 is used to efficiently collect the X-ray and to narrow the irradiation diameter of the X-ray to a certain extent. The X-ray is then introduced into SCX 3 without waste where the X-ray is further focused so that the X-ray is irradiated onto a very small area on, for example, inspected object 11. By so doing, even though the intensity of the X-ray that is generated by X-ray source 12 may not be that high, an X-ray of a strong intensity can be irradiated onto a micro-area, allowing information on components that are present at that area to be acquired with a high sensitivity.

The X-ray incident end portion of MCX 2 in the afore-described embodiment was a parallel end. This is effective when the X-ray source has a size that is greater than a certain value. If the X-ray source is of the size that allows it to be considered as substantially being a single point and if the X-ray is radially emitted from there, it is acceptable to use a MCX whose X-ray incident end part is a converging end with a point focus. Stated otherwise, MCX 2 that is used here can either be a point/parallel type or a point/point type.

Figure 4:
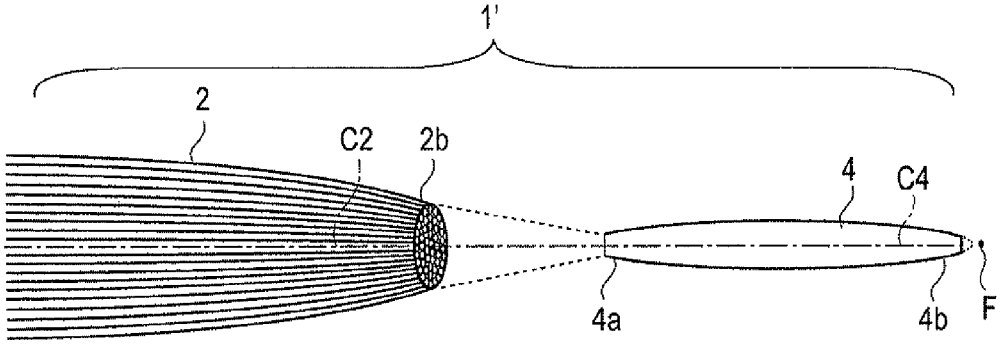
FIG. 4 shows the configuration of the major elements of a variation of the X-ray focusing device according to the present invention.
Figure 5A:
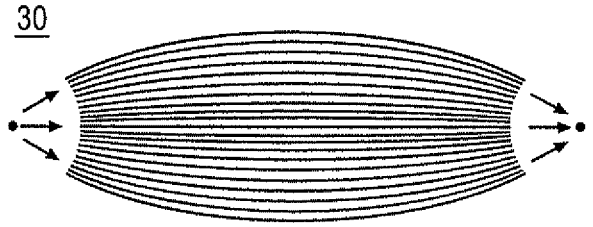
FIG. 5 shows an example of a mode of a multi-capillary X-ray lens.
Figure 5B:
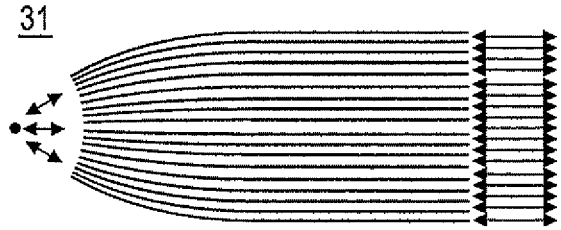
Figure 6A:
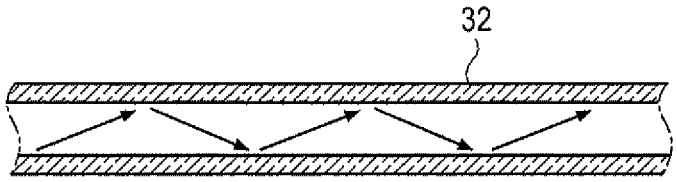
FIG. 6 shows the principle behind the transmission of X-rays in a multi-capillary X-ray lens.
Figure 6B:
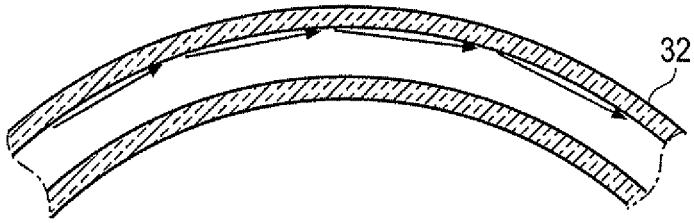
Figure 7:
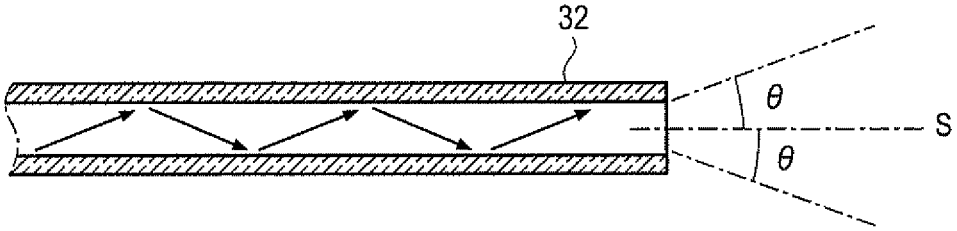
FIG. 7 shows a problem besetting previous multi-capillary X-ray lens.
Figure 8:
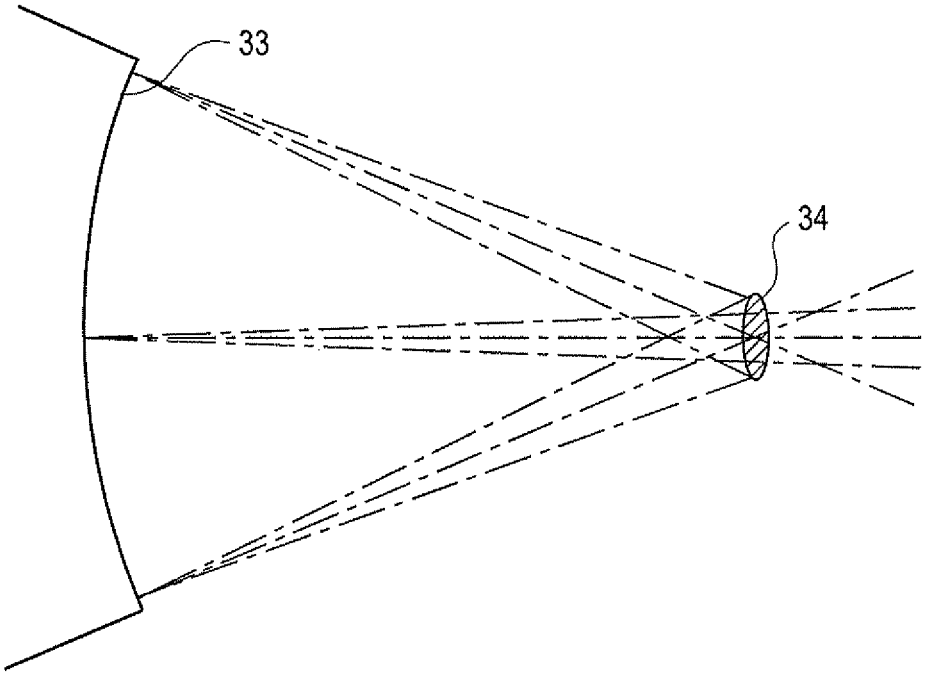
FIG. 8 shows a problem besetting previous multi-capillary X-ray lens.
Figure 9:
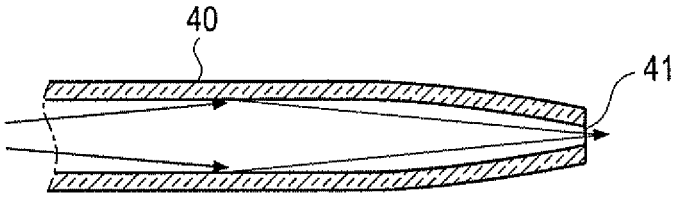
FIG. 9 shows the principle behind the transmission of X-rays in a single-capillary X-ray lens.

FIG. 4 shows the configuration of the major elements of a variation of the X-ray focusing device 1' according to the present invention. Here, MCX 2 is the same as that in the embodiment shown in FIG. 1, but the shape of SCX 4 is different. To explain, with SCX 4, both ends are spheroid-shaped converging ends. However, the end portion 4*a* that opposes the converging end 2*b* of MCX 2 is a spheroid-shaped converging end with a long-focal length. The end part 4*b* at the side where the X-ray is irradiated externally is a spheroid-shaped converging end of a short focal length. The X-ray that is emitted from the converging end 2*b* of MCX 2 proceeds towards the focal point, and the X-ray diverges once the focal point is passed. However, as stated earlier, the size of the focal point is relatively large. If the focal point on the output side of MCX 2 is situated near the spheroid focal point of the spheroid-shaped converging end 4*a* of SCX 4 with a long-focal length, the X-ray is efficiently incorporated into SCX 4. The X-ray undergoes total reflection inside SCX 4 and is irradiated in a concentrated manner from spheroid-shaped converging end 4*b* having a short focal length onto a very small focal point F.

In this way, with the X-ray focusing device according to the present invention, the SCX that is combined with the MCX need not necessarily be a parallel/point type and can also be a point/point type.

Furthermore, the afore-described embodiments are just examples of the present invention, and needless to say, various modifications, changes and additions can be made within the scope of the thrust of the present invention and still be included within the scope of the claims.

DESCRIPTION OF THE NUMERICAL REFERENCES

1. X-ray focusing device
2. Multi-capillary X-ray lens (MCX)
2*a*. Parallel end
2*b*. Converging end
3, 4, Single capillary X-ray lens (SCX)
3*a*. Parallel end
3*b*, 4*a*, 4*b*. Converging end

What is claimed is:

1. An X-ray focusing device comprising:

a multi-capillary lens comprising a plurality of bundled capillaries for guiding X-rays, wherein at least one end face of said multi-capillary lens is a converging end for concentrating and irradiating X-rays to a micro-area located outside of the end face; and a single-capillary lens comprising one capillary for guiding X-ray, wherein at least one end face of said single-capillary lens is a converging end for irradiating X-ray to the micro-area located outside of the end face where the micro-area is smaller than the irradiation area of the X-ray converged by the multi-capillary lens, and the other end face is a long-focal length converging end or a parallel end capable of accepting parallel X-ray beams where the long-focal length converging end or the parallel end has a focal length that is longer than the focal length of the converging end of the single-capillary lens for irradiating X-ray, and wherein the parallel end or the long-focal length converging end of said single-capillary lens is positioned outside the converging end of said multi-capillary lens, and said multi-capillary lens and said single-capillary lens are positioned so that the optical axis of said multi-capillary lens at the converging end coincides with the optical axis of the single-capillary lens at the parallel end or the long-focal length converging end.

2. The X-ray focusing device according to claim 1, wherein the single-capillary lens is a substantially tubular shape with a tapered tip at the converging end.

3. An X-ray focusing device comprising:

a multi-capillary lens comprising a plurality of bundled capillaries for guiding X-rays, wherein at least one end of said multi-capillary lens is a converging end for concentrating and irradiating X-rays to a micro-area outside of the one end; and a single-capillary lens comprising one capillary for guiding X-ray, wherein a first end of said single-capillary lens is a spheroid-shaped converging end with a short-focal length for irradiating X-ray to the micro-area outside of the first end, and a second end, opposite to the first end, is a spheroid-shaped converging end with a long-focal length, opposing the one end of the multi-capillary lens, whereby the second end of the single-capillary lens has a focal length that is longer than the first end of the single-capillary lens for irradiating X-ray, and wherein the second end of said single-capillary lens is positioned outside the converging end of said multi-capillary lens, and said multi-capillary lens and said single-capillary lens are positioned to have the optical axis coincide.

* * * * *